United States Patent [19]

Pickering et al.

[11] 4,311,968

[45] Jan. 19, 1982

[54] MAGNETRON HAVING CAVITY WALL VIBRATED BY TUNING FORK

[75] Inventors: Alan H. Pickering; Geoffrey J. Rowlands, both of Chelmsford, England

[73] Assignee: English Electric Valve Company Limited, Chelmsford, England

[21] Appl. No.: 100,003

[22] Filed: Dec. 4, 1979

[30] Foreign Application Priority Data

Dec. 5, 1978 [GB] United Kingdom ..... 47235/78
Nov. 19, 1979 [GB] United Kingdom ..... 39909/79

[51] Int. Cl.[3] ..... H01J 23/20; H01J 25/50

[52] U.S. Cl. ..... 331/90; 315/39.59; 315/39.61; 331/156; 331/178

[58] Field of Search ..... 331/86, 90, 87, 5, 156, 331/178, 116 M; 315/39.51, 39.55, 39.59, 39.61; 332/5

[56] References Cited

U.S. PATENT DOCUMENTS

| | | | |
|---|---|---|---|
| 3,087,124 | 4/1963 | McLeod, Jr. | 331/5 X |
| 3,440,565 | 4/1969 | Scullin et al. | 331/90 X |
| 3,493,292 | 2/1970 | Dostal | 331/156 X |
| 3,727,099 | 4/1973 | Burwell et al. | 315/39.61 X |

*Primary Examiner*—Siegfried H. Grimm
*Attorney, Agent, or Firm*—Spencer & Kaye

[57] ABSTRACT

A co-axial magnetron in which the microwave output frequency can be rapidly altered within a particular frequency band. A movable tuning plate is coupled to a mechanical tuning fork which is set into vibration by an alternating voltage applied to a solenoid.

10 Claims, 7 Drawing Figures

MAGNETRON HAVING CAVITY WALL VIBRATED BY TUNING FORK

IMPROVEMENTS IN OR RELATING TO MAGNETRONS

Figure 1:
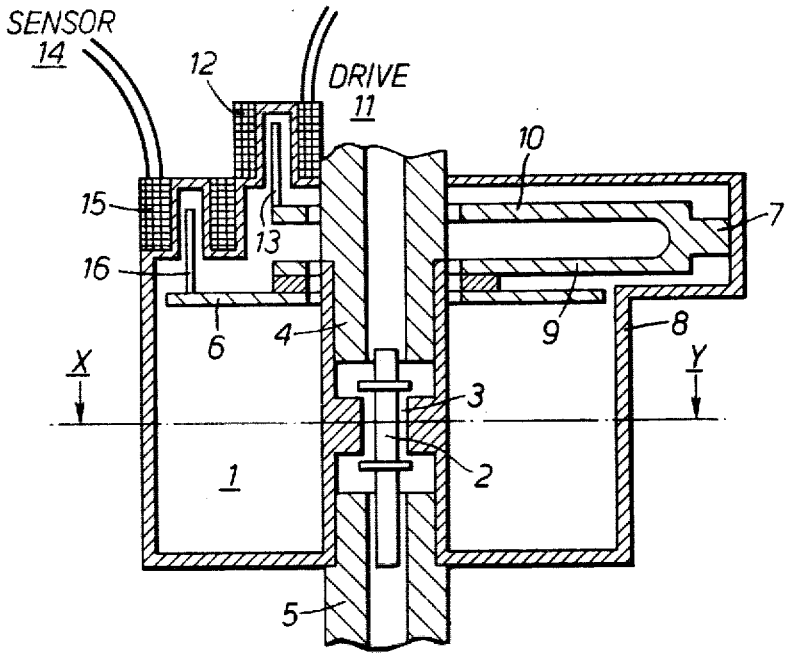

This invention relates to magnetrons. A magnetron produces a microwave output signal whose frequency is primarily dependent on the frequency characteristics of a resonant chamber associated with the magnetron. By altering the electrical properties of the chamber, the frequency of oscillation of the magnetron can be adjusted and this is often necessary to provide fine tuning of its output frequency. It is sometimes desirable to sweep the frequency of resonance periodically over a predetermined frequency range, but it is difficult to obtain fast sweep rates since the mechanical actuators and linkages usually necessary to produce an alteration of the electrical properties of the resonator exhibit a relatively great mechanical inertia.

The present invention seeks to provide an improved magnetron in which the restriction on the frequency sweep rate due to the effect of mechanical inertia is reduced.

According to a first aspect of this invention a magnetron includes a movable conductive means which is movable relative to a resonant cavity for determining the frequency of oscillation of a microwave output signal, and a mechanical resonator coupled to said movable conductive means for cyclically altering the resonant frequency of the cavity by inducing vibratory motion in said movable conductive means.

The magnetron may be of the kind in which the frequency of oscillation is determined by the penetration of conductive rods or the like into a plurality of resonant cavities forming part of the electron interaction space of the magnetron, and which cavities together encircle a cathode. In this case it is desirable to couple all the conductive rods to the mechanical resonator, and this may result in a relative complex structure. The invention is therefore advantageously applicable to a so-called co-axial magnetron.

According to a second aspect of this invention, a co-axial magnetron includes an annular resonant cavity whose axis is aligned with that of an elongate cathode and which cavity is provided with a movable conductive end plate, a mechanical resonator coupled to said movable plate so as to vibrate it and thereby to cyclically alter the resonant frequency of the cavity, and means coupled to said mechanical resonator for generating a signal representative of the instantaneous resonant frequency of the cavity.

Preferably the mechanical resonator is located within a vacuum enclosure containing the magnetron anode and the annular resonant cavity.

Preferably the mechanical resonator comprises a tuning fork, one arm of which is rigidly connected to said movable plate.

Preferably the mechanical resonator is maintained in resonance by means of a vibrating drive means, arranged to be driven through the wall of the vacuum enclosure at the natural frequency of resonance of the resonator. The natural frequency of resonance is of course affected by the inertia of said movable plate and the drive means, and preferably the vibratory drive means forms part of a feedback loop in which sensor means arranged to sense the mechanical vibrations of the mechanical resonator is coupled via an adjustable phase shifter to said vibratory drive means.

Preferably the vibratory drive means comprises a solenoid, the movable ferromagnetic member of which is carried by the mechanical resonator, with the electromagnetic coil of the solenoid being located outside the vacuum enclosure.

Advantageously two movable conductive end plates are provided, one at each end of the cavity, the movable plates being coupled to respective ones of two arms of the tuning fork. In this way, for a given degree of excitation of the tuning fork, twice the tuning frequency range for the magnetron can be achieved.

Alternatively two independent mechanical resonators could be provided, each being coupled respectively to a movable end plate at opposite ends of said cavity.

The sensor means is preferably arranged to sense movement of the arm of the tuning fork which is rigidly connected to said movable plate, and the drive means is arranged to drive the other arm of the tuning fork.

In this case conveniently the other arm of the tuning fork carries the ferromagnetic member.

Figure 2:
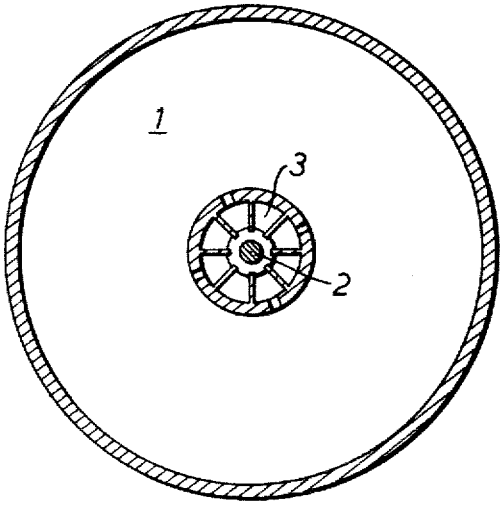
Figure 3:
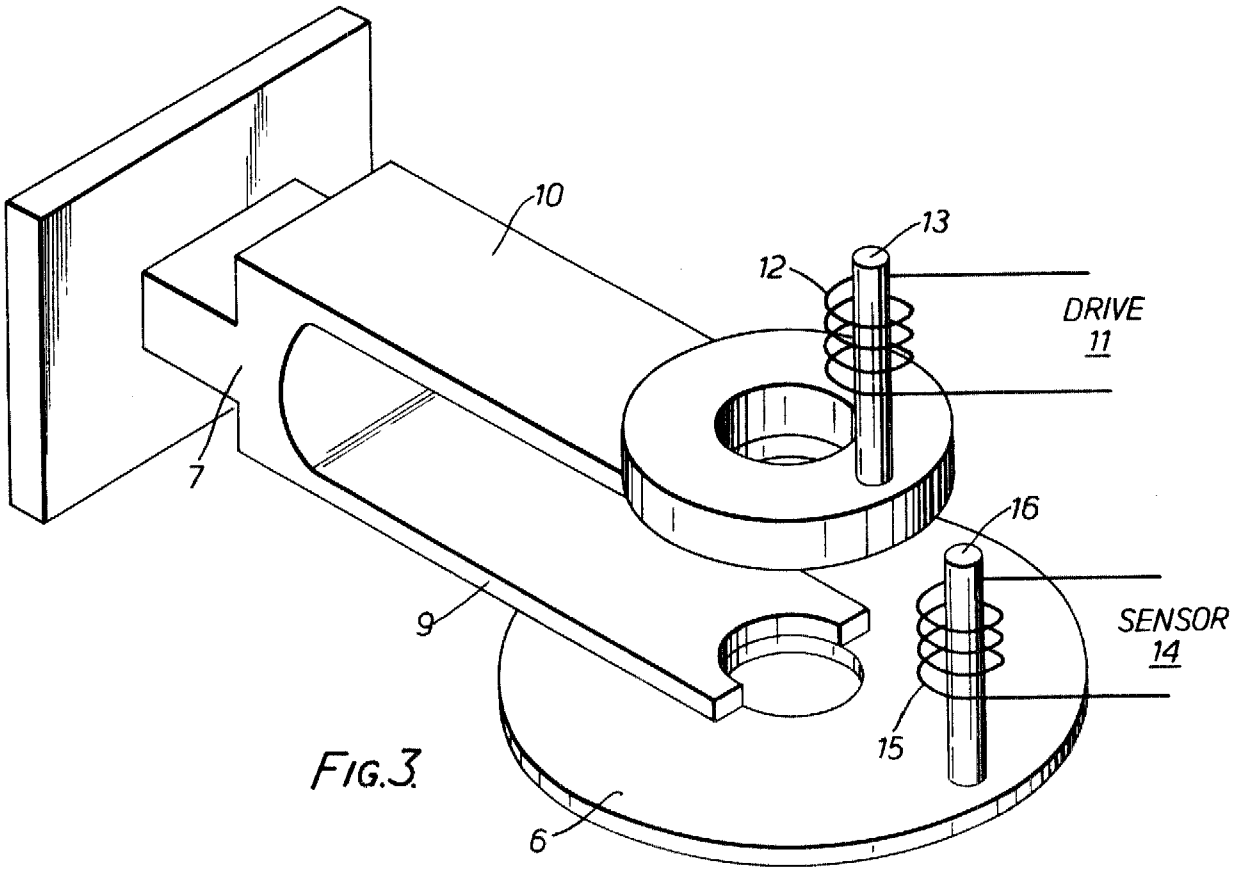
Figure 4:
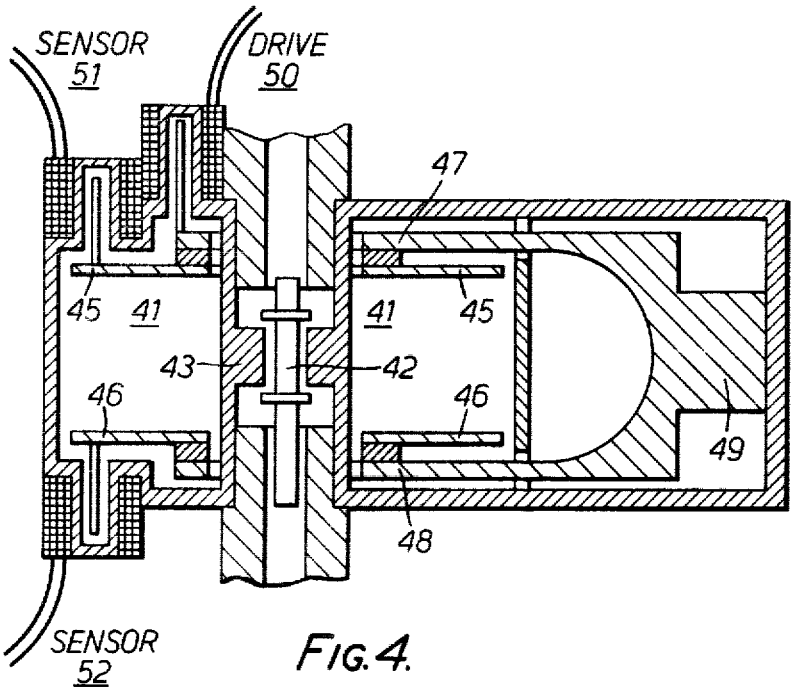
Figure 7:
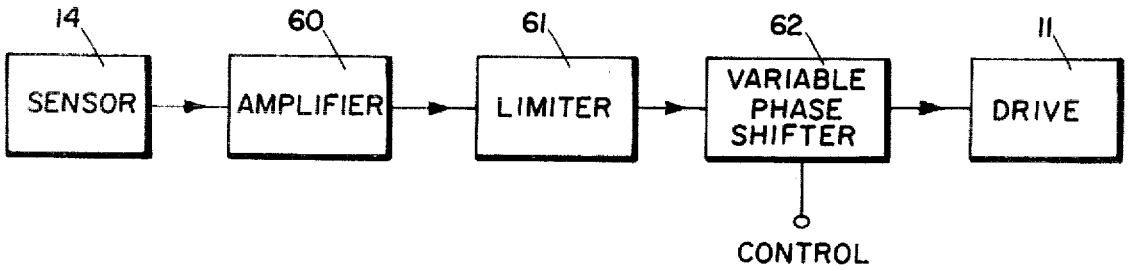
Figure 5:
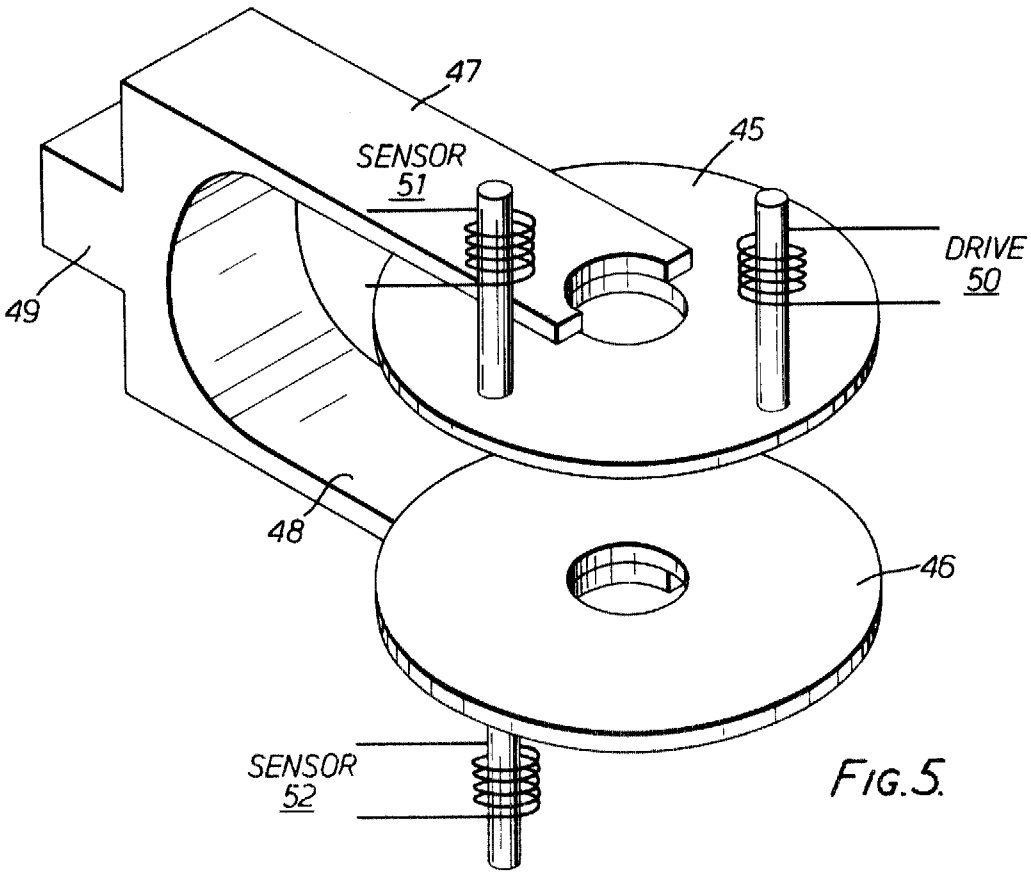
Figure 6:
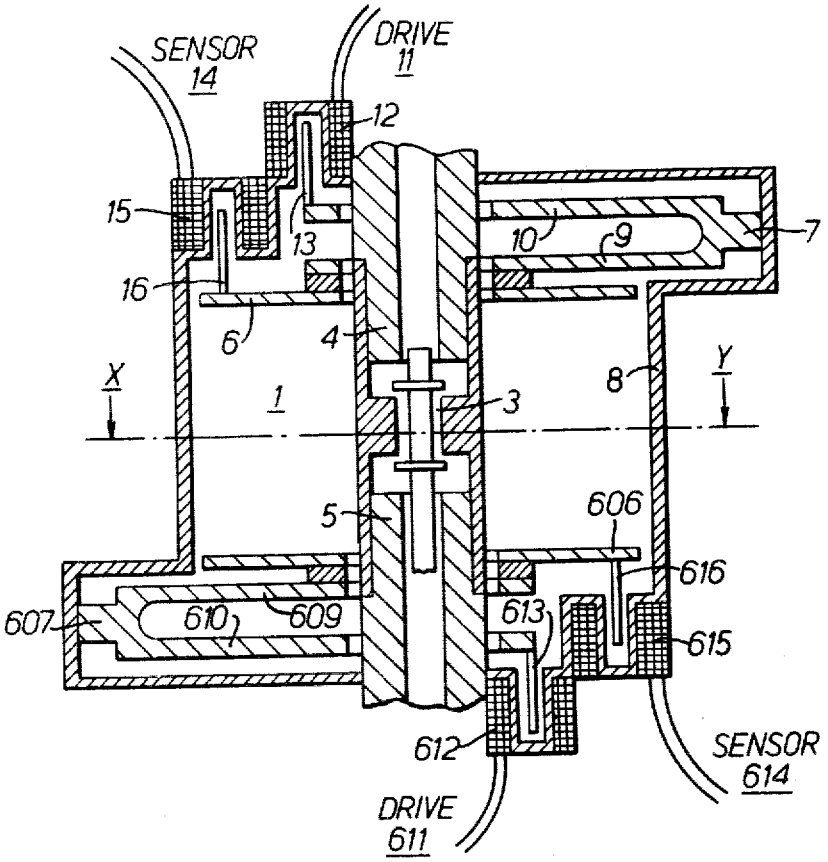

The invention is further described by way of example with reference to the accompanying drawings in which, FIG. 1 shows a section view of a co-axial magnetron in accordance with the present invention, FIG. 2 shows a further sectional view taken on the line X-Y of FIG. 1, FIG. 3 illustrates part of the magnetron in greater detail, FIGS. 4 and 5 show a modified embodiment of the present invention, FIG. 6 shows an alternative embodiment of the invention, and FIG. 7 shows a feedback loop for use with the magnetron.

Referring to the drawings, a co-axial magnetron consists of an annular cavity 1 which surrounds an elongate cathode 2 and an interaction space 3 consisting of a large number of individual cavities which are spaced regularly around the cathode 2. These cavities constitute the anode structure. A magnetic field is produced within the interaction space 3 by means of magnets 4 and 5. The upper end of the annular cavity 1 is closed by means of a conductive ring-shaped end wall 6.

As so far described, the co-axial magnetron is well known and is conventional and it is not thought necessary to describe its construction, particularly the nature of the structure defining the interaction space, in great detail.

In operation electrons are emitted by the cathode 2 into the interaction space 3 when a large potential, usually in pulse form is applied between the cathode and the anode structure. The electrons set up microwave oscillations under the influence of the magnetic field and under the influence of the very high electric field which exists between the anode walls of the interaction space 3 and the cathode 2. The resonant frequency is determined by the electrical properties of the interaction space 3 and by the resonant frequency of the annular cavity 1. By moving the end plate 6, the frequency of operation can be adjusted over at least a relatively small range.

In accordance with the invention the plate 6 is coupled to a mechanical resonator which is constituted by a tuning fork 7 which is clamped to an outer evacuated envelope 8 of the magnetron so that the tuning fork 7 operates wholly within the vacuum. The interior of the evacuated envelope 8 is maintained at a very high level of vacuum. One arm 9 of the tuning fork is rigidly fixed to the upper surface of the plate 6, and the other arm 10 of the tuning fork 7 is coupled to a drive unit 11 which sets the tuning fork into oscillatory vibration by driving it through the wall of the envelope 8. The drive unit 11 consists of a solenoid in which an electromagnetic coil 12 is rigidly mounted on the outside of the envelope 8, and a small magnet or piece of magnetic material 13 (which could be in the form of a tube or rod) which is carried by the arm 10 of the tuning fork within the envelope 8. If necessary the wall of the envelope 8 in the region of the solenoids may be of a material which enhances the passage of the electromagnetic forces. An alternating current passed through the coil 12 at the resonant frequency of the tuning fork 7 induces mechanical vibrations which are coupled to the plate 6. In this way the resonant frequency of the magnetron can be changed rapidly and cyclically over a frequency range determined by the amplitude of movement of the arm 9.

A sensor unit 14 is coupled to the arm 9 of the tuning fork so as to provide an indication of the resonant frequency of the magnetron and also to provide a feedback signal to the drive unit 11. In the arrangement illustrated, the read unit 14 consists of a coil 15 mounted on the envelope 8 and a conductive tube 16 mounted on the arm 9. As the arm 9 vibrates up and down the effective inductance of the coil 15 is altered. By arranging that the coil 15 forms part of a balanced bridge network the variation in inductance unbalances the bridge and provides a corresponding control signal. As shown in FIG. 7, the output obtained from the bridge network associated with the read unit 14 is passed via an amplifier 60 and limiter 61 to a variable phase shifter 62, the output of which is fed back to the drive unit 11. The phase shifter is then adjusted to produce a positive feedback signal and hence the required resonance of the tuning fork 7. The magnitude of the movement of the arms 9 and 10 is determined by the limiter referred to above and the value is chosen with regard to the frequency sweep required.

As the sensor unit 14 is attached to the arm 9 of the tuning fork 7 which carries the tuning plate 6, and the drive unit 11 is attached to the other arm 10, the system acts as a four terminal network which can be used as an electrical filter to determine the frequency of oscillation. Oscillation will then always occur at the natural frequency of resonance of the tuning fork, even if this changes in value due to, for example, temperature changes.

When the tuning fork is in its normal mode of operation in which the two arms are in antiphase, mechanical losses and coupling to the supporting envelope 8 are very small. The power required by the drive unit 11 is small and the oscillation is insensitive to extreme vibrations of the magnetron. A second sensor unit (not shown) can be attached to the driven arm 10 of the tuning fork, and by electrically combining its output with that of the other sensor unit 14, the effects of external vibrations on the output frequency of the magnetron can be reduced still further.

FIGS. 4 and 5 show an alternative embodiment of the present invention in which, for a given degree of excitation of the tuning fork twice the tuning frequency range of the magnetron can be obtained. This is achieved by making both ends of the tuning cavity movable instead of just one end as is usual. Referring to the drawings, a co-axial cavity 41 surrounds an interaction space 43 and cathode 42, the cavity 41 being provided with two movable conductive end plates 45 and 46. Each end plate is of annular shape and is fixed rigidly to a respective arm 47 or 48 of a tuning fork 49. Remaining portions of the magnetron which correspond to those shown in previous figures are not described again in detail.

The upper end plate 45 is provided with a drive unit 50 which sets the tuning fork into oscillation, and these oscillatory vibrations are sensed by sensor units 51 and 52, which are mounted one on each end plate 45 and 46. The sensor unit 52 is coupled to the drive unit 50 to form a feedback loop to control the frequency and magnitude of the vibrations, and hence the output characteristics of the magnetron. The use of two movable end plates means that the magnetrón is relatively insensitive to any in-phase excitation of the tuning fork arms, as would be produced by external vibration, as tuning results only from movement of the two end plates relative to one another.

FIG. 6 shows a further embodiment of the present invention in which two separate mechanical resonators, each in the form of a tuning fork, are provided to alter the frequency of oscillation of the magnetron. The construction shown in FIG. 6 is somewhat similar to that shown in FIG. 1, but with the provision of a separate tuning fork at both ends of the co-axial cavity 1. The structure shown at the upper end of the cavity 1 is identical to that illustrated in FIG. 1 and the same reference numerals have been used. The tuning mechanism at the lower end of the cavity 1 is very similar and the same reference numerals, prefixed by the numeral 6 have been used to indicate like parts. As before the outer envelope 8 of the magnetron constitutes a highly evacuated envelope within which both tuning forks 7 and 607 are mounted so that they oscillate within a very high vacuum.

Separate drive means 611 are provided for the additional tuning fork 607 and again it constitutes a solenoid in which the electromagnetic coil 612 and 615 is mounted on the outer surface of the envelope 8, whilst the movable ferromagnetic member 613 is within the evacuated envelope and is carried by the arm 610 of the tuning fork 607. Separate sensor means 614 is similarly provided. It takes the same form as sensor 14, and allows the position of the tuning plate 606 to be precisely known at any instant.

Although both tuning forks 7 and 607 may have identical resonance frequencies, it is preferred to provide them with different resonance frequencies so as to enhance the rate and manner in which the oscillation frequency of the magnetron can be changed.

We claim:

1. A co-axial magnetron comprising an evacuated enclosure defining an anode and an annular resonant cavity, said cavity having a longitudinal axis;

an elongated cathode positioned within said enclosure and aligned with the longitudinal axis of said cavity;

at least one movable conductive plate positioned within said enclosure and forming an end of said cavity;

a tuning fork having a pair of arms located within said enclosure, one arm of said tuning fork being ridigly connected to said movable plate to transfer mechanical vibrations to said plate and thereby cyclically alter the resonant frequency of said cavity; and sensor means coupled to said tuning fork for generating a signal corresponding to the instantaneous resonant frequency of said cavity.

2. A magnetron as claimed in claim 1 and wherein two movable plates are provided, one at each end of the cavity, with each movable plate being coupled to a tuning fork.

3. A magnetron as claimed in claim 2 and wherein a single tuning fork is provided with respective ones of its two arms being coupled to each movable plate.

4. A magnetron as claimed in claim 2 and wherein two tuning forks are provided, one arm of each of which is coupled to a respective movable plate.

5. A magnetron as claimed in claim 4 and wherein the two tuning forks have mutually different natural frequencies of resonance.

6. A magnetron as claimed in any of claims 2 to 4 and wherein the tuning fork(s) is maintained in resonance by means of a vibratory drive means, arranged to be driven at the natural frequency of resonance of the tuning fork(s).

7. A magnetron as claimed in claim 6 and wherein the vibratory drive means forms part of a feedback loop in which said sensor means arranged to sense the mechanical vibrations of the tuning fork is coupled via an adjustable phase shifter to said vibratory drive means.

8. A magnetron as claimed in claim 6 wherein the vibratory drive means comprises a solenoid, the electromagnetic coil of which is located outside said enclosure and the ferromagnetic member of which is carried by the tuning fork within said enclosure.

9. A magnetron as claimed in claim 7 wherein said vibratory drive means is arranged to drive the other of the two arms of said tuning fork.

10. A magnetron including movable conductive means which is movable relative to an annular resonant cavity for determining the frequency of oscillation of a microwave output signal, and characterized by a mechanical resonator in the form of a tuning fork which is located within a vacuum enclosure containing the magnetron anode and said annular resonant cavity, and wherein one arm of said tuning fork is rigidly connected to said movable conductive means so as to vibrate it and thereby to cyclically alter the resonant frequency of the cavity, and means coupled to said tuning fork for generating a signal representative of the instantaneous resonant frequency of the cavity.

* * * * *